US008919055B2

(12) United States Patent
Nelson

(10) Patent No.: US 8,919,055 B2
(45) Date of Patent: Dec. 30, 2014

(54) POOL LINER RETAINER

(71) Applicant: P.I. Inc., Athens, TN (US)

(72) Inventor: Laurence A. Nelson, Knoxville, TN (US)

(73) Assignee: P.I., Inc., Athens, TN (US)

( * ) Notice: Subject to any disclaimer, the term of this patent is extended or adjusted under 35 U.S.C. 154(b) by 0 days.

(21) Appl. No.: 13/833,695

(22) Filed: Mar. 15, 2013

(65) Prior Publication Data

US 2014/0260004 A1 Sep. 18, 2014

(51) Int. Cl.
*E04F 11/00* (2006.01)
*E04H 4/14* (2006.01)
*E04F 11/09* (2006.01)

(52) U.S. Cl.
CPC ..... *E04H 4/144* (2013.01); *E04F 11/09* (2013.01)
USPC ..... 52/182; 52/184

(58) Field of Classification Search
USPC ..... 52/182, 184, 188; 4/506
See application file for complete search history.

(56) References Cited

U.S. PATENT DOCUMENTS

| | | | | | |
|---|---|---|---|---|---|
| 3,427,663 | A * | 2/1969 | O'Connell et al. | ..... | 52/716.2 |
| 3,478,370 | A * | 11/1969 | Purpuri et al. | ..... | 52/188 |
| 3,848,378 | A * | 11/1974 | Witte | ..... | 52/184 |
| 4,343,120 | A * | 8/1982 | Witte | ..... | 52/184 |
| 4,713,849 | A * | 12/1987 | Kindness | ..... | 4/496 |
| 4,951,434 | A * | 8/1990 | Schmidt | ..... | 52/191 |
| 5,400,556 | A * | 3/1995 | Favaron | ..... | 52/182 |
| 6,671,895 | B2 * | 1/2004 | Lewis | ..... | 4/506 |
| 2013/0007956 | A1 * | 1/2013 | Korbel | ..... | 4/506 |

* cited by examiner

*Primary Examiner* — Basil Katcheves
(74) *Attorney, Agent, or Firm* — Pitts & Lake, P.C.

(57) ABSTRACT

A pool stair assembly includes step members having riser panels and tread panels, the step members joined together to form a multi-step structure. In illustrative embodiments, a spacer is located between a connection flange of a first step member and a riser panel of a second step member to form a channel therebetween, with one or more detents extending into the channel. A swimming pool liner includes locking tabs at predetermined locations that correspond to the channel, the locking tabs insertable into the channel to secure the liner to the step members. When the locking tab is inserted, a lip of the locking tab is compressed against the detent to move the locking tab past the detent when sufficient downward force is applied. The lip naturally biases back to its original position after passing the detent, preventing removal of the locking tab from the channel.

33 Claims, 7 Drawing Sheets

14
15
16
18
20
22
24
26
28
30
32
40
42
46
48
50
52
56
60
62
64
120
121
122
123
126
128

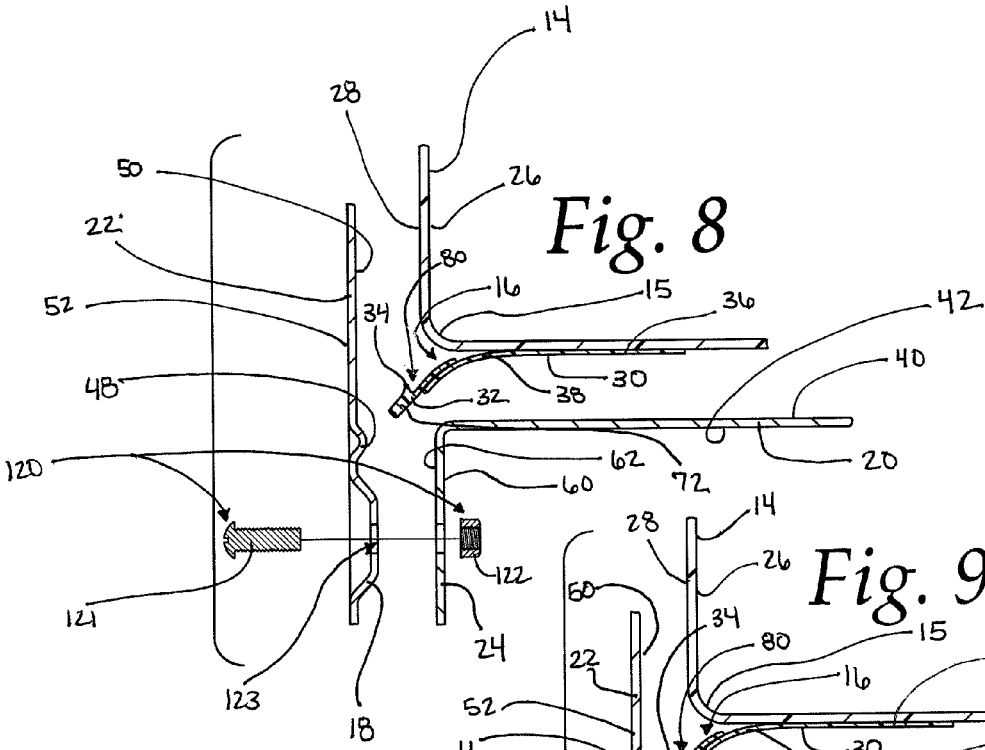
Fig. 8
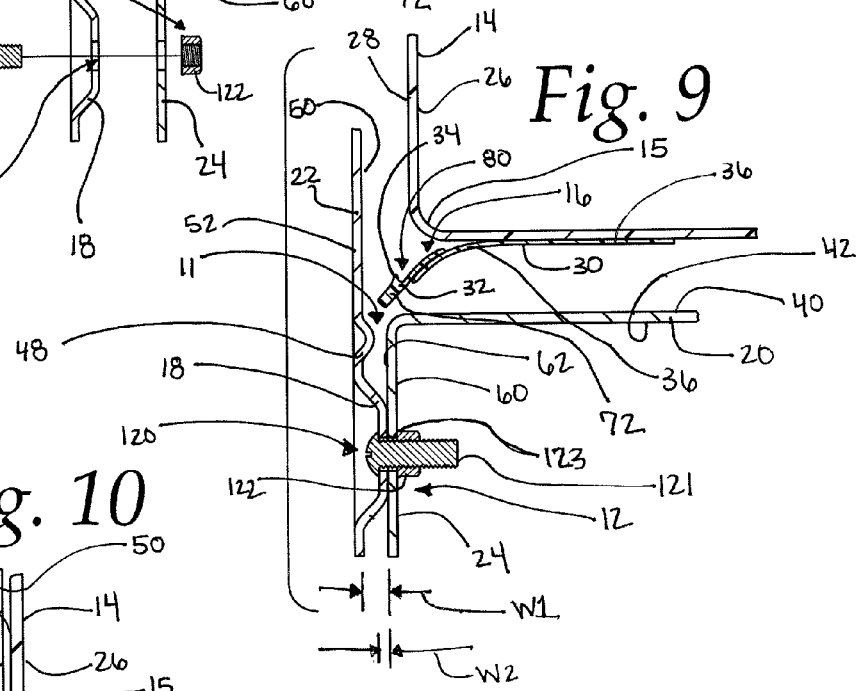
Fig. 9
Fig. 10
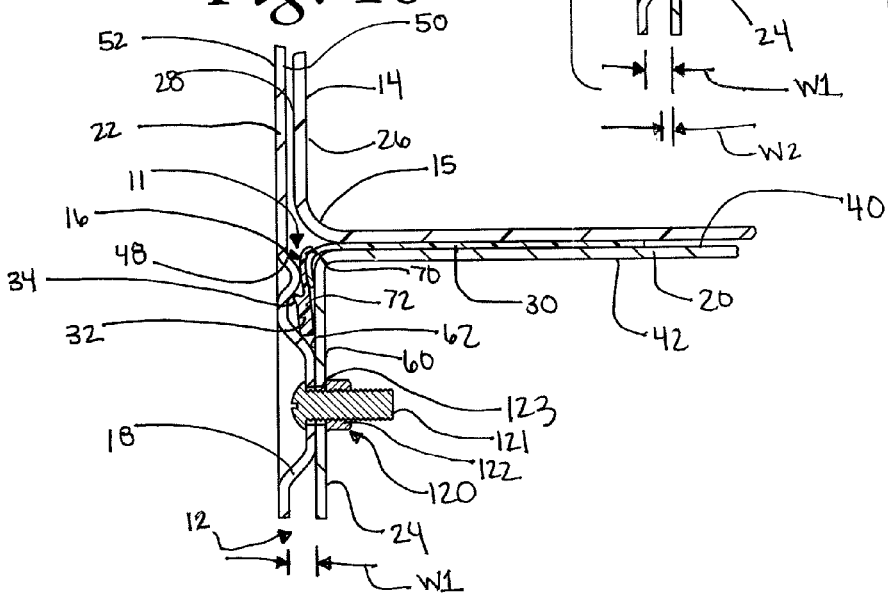

POOL LINER RETAINER

BACKGROUND

The present disclosure relates to swimming pools and more particularly to the retainment of a water tight liner used in the construction of swimming pools. More particularly, the present disclosure relates to a locking tab used to secure the liner to a stair assembly of a swimming pool.

SUMMARY

In accordance with the present disclosure, a swimming pool liner is provided to be secured to a stair assembly of a swimming pool through the use of one or more locking tabs secured to an underside of the pool liner. The locking tabs are configured to be attached to the underside of the pool liner at predetermined locations that correspond to channels formed in the stair assembly, the locking tabs including a free-hanging tab extension that can be inserted into the channels to secure the pool liner against the stair assembly.

In illustrative embodiments, the pool stair assembly includes one or more step members. Each step member includes a riser panel, a tread panel extending behind and away from the riser, and a connection flange coupled to the tread panel. The connection flange of a first step member is placed in parallel alignment with the riser panel of a second, adjoining step member when multiple step members are coupled together to create a multi-step stair structure. A plurality of spacers is located between the connection flange of the first step member and the riser panel of the second step member such that a channel is formed when the connection flange and riser panel are coupled together, the channel being parallel with a back edge of the tread panel of the first step member. One or more detents extend into the channel and are spaced apart from each other along the channel.

In illustrative embodiments, locking tabs secured to an underside of the pool liner are located at predetermined positions to generally align with the channel formed in the stairs when the swimming pool liner is aligned correctly with the stair assembly. When the locking tab is inserted into the channel, a lip of the locking tab is compressed to allow the lip and a tab extension, coupled to the lip, to move past the detent when sufficient downward force is applied. The lip will be naturally biased back to its original position after passing the detent, abutting against a bottom side of the detent to prevent removal of the locking tab from the channel.

Additional features of the disclosure will become apparent to those skilled in the art upon consideration of the following detailed description of illustrative embodiments exemplifying the best mode of carrying out the disclosure as presently perceived.

BRIEF DESCRIPTION OF THE DRAWINGS

The detailed description particularly refers to the accompanying figures in which:

FIG. 8 is a cross-sectional side view of the stair assembly of FIG. 4 prior to assembly;

FIG. 9 is a cross-sectional side view of the stair assembly of FIG. 4 after the step members are assembled together to form the channel but prior to insertion of the locking tab into the channel;

FIG. 10 is a cross-sectional side view of the stair assembly of FIG. 4 after the locking tab has been inserted into the channel and a lip of the locking tab abuts against a detent extending into the channel, blocking upward movement of the locking tab;

DETAILED DESCRIPTION

Figures 1, 2:
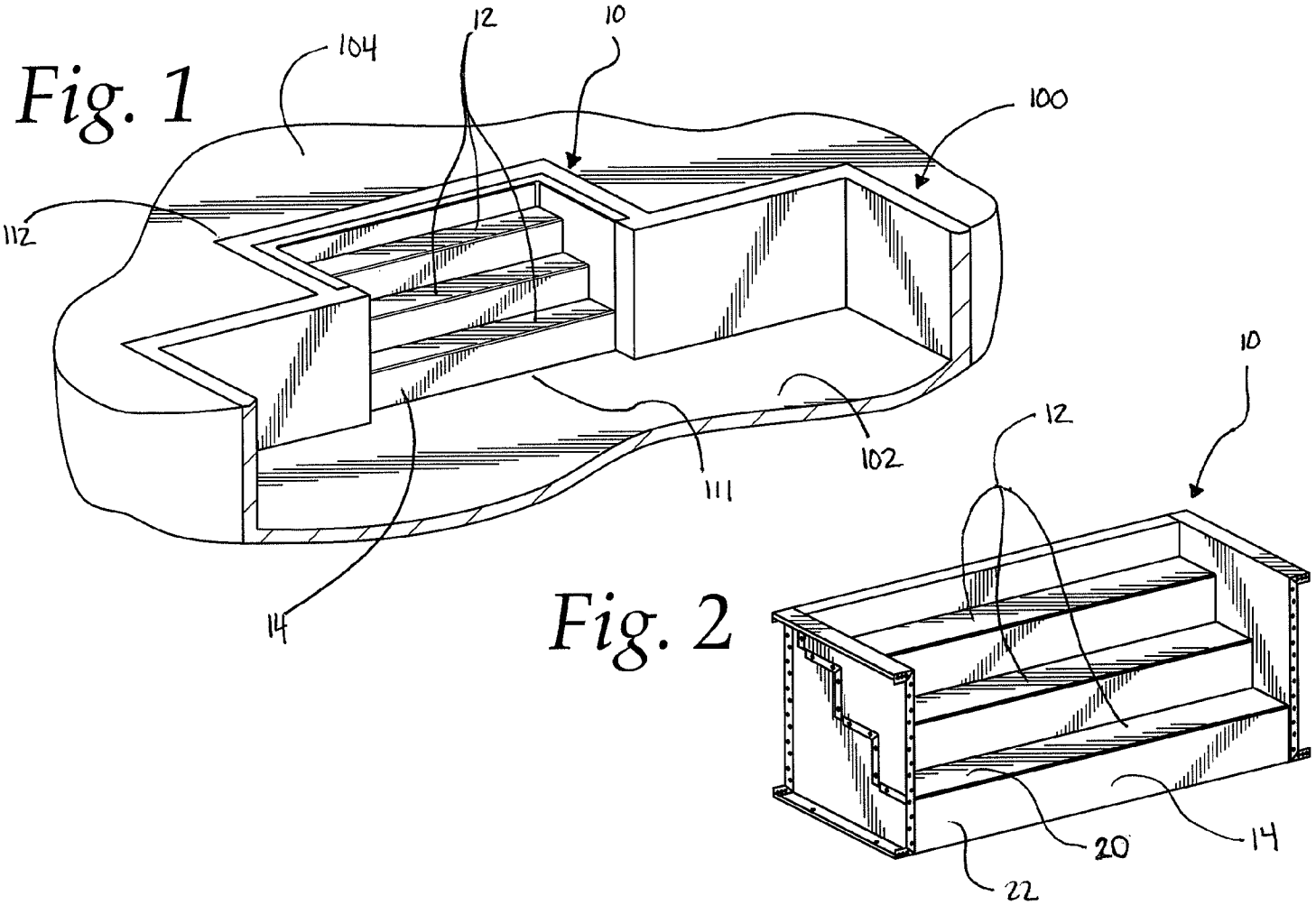
FIG. 1 is an front partial perspective view of a swimming pool with a stair assembly in accordance with the present disclosure.
FIG. 2 is a front perspective view of a series of step members of the stair assembly of FIG. 1, the step members coupled together to form a multi-step stair structure.
Figures 4, 5:
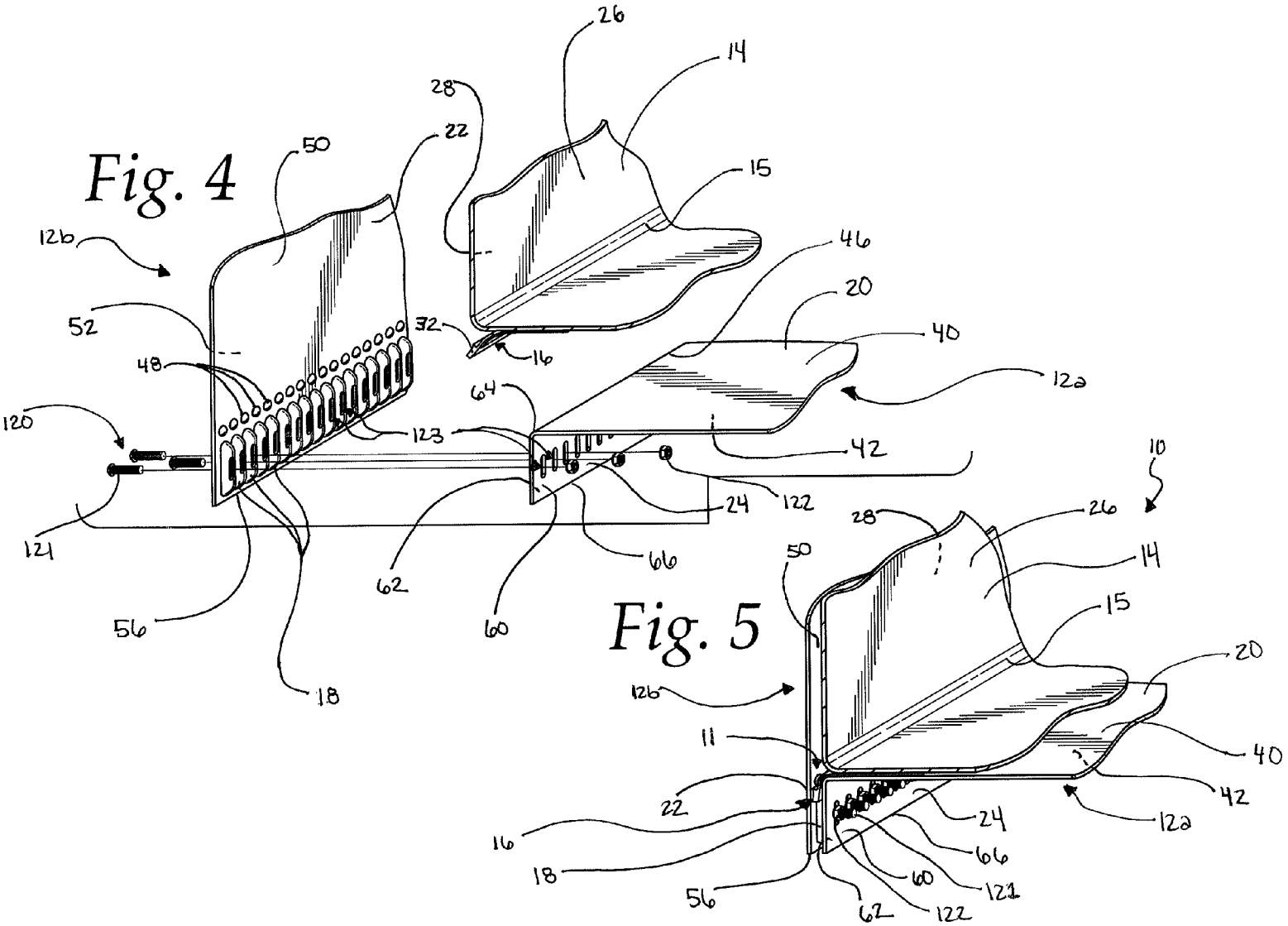
FIG. 4 is an exploded perspective view of the stair assembly of the present disclosure, the stair assembly including spacers molded into a step member to form a channel between the step members, the channel configured to receive a locking tab.
FIG. 5 is an assembled perspective view of the stair assembly of FIG. 4.

In illustrative embodiments, a pool stair assembly 10 includes one or more step members 12, a pool liner 14 secured to step member 12, and a locking tab 16 coupled to a bottom surface 28 of pool liner 14 to secure liner 14 to step members 12. As illustrated in FIGS. 1 and 2, step members 12 are configured to be coupled together to allow stair assembly 10 to ascend from a first level 111 aligned with a base 102 of a swimming pool 100 to a higher second level 112 aligned with a surface 104 of the area surrounding swimming pool 100. As illustrated in FIGS. 4 and 5, locking tab 16 is configured to be inserted into a channel 11 between step members 12 when step members 12 are coupled together. Once inserted into channel 11, locking tab 16 is difficult to remove from step members 12, preventing pool liner 14 from unintentionally slipping or moving with respect to step members 12.

Figure 15:
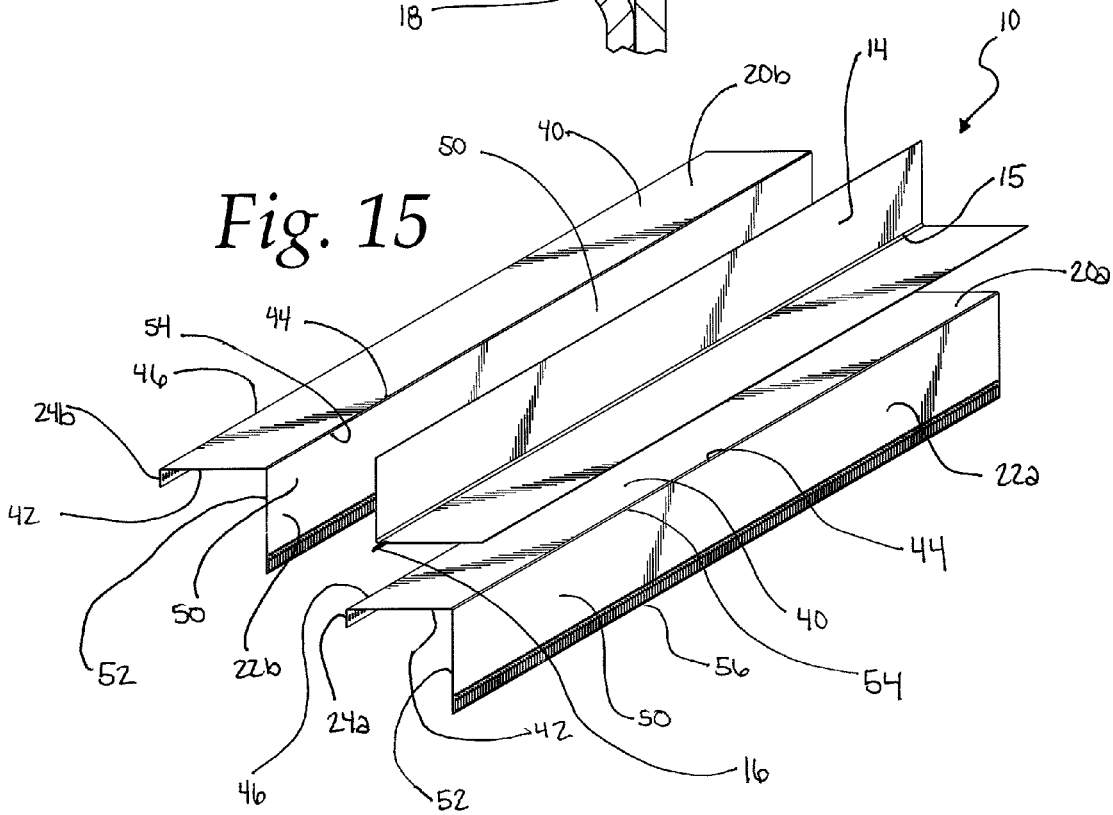
FIG. 15 is an exploded full view of the stair assembly of FIG. 4.

Each step member 12 of pool stair assembly 10 includes a tread panel 20, a riser panel 22 coupled to tread panel 20, and a connection flange 24 coupled to tread panel 20 at a point spaced away from where riser panel 22 couples to tread panel 20, as illustrated in FIG. 15. In the illustrative embodiments, tread panel 20 is generally parallel with base 102 of swimming pool 100. Riser panel 22 and connection flange 24 are generally parallel with each other and generally perpendicular to base 102 of swimming pool 100 and tread panel 20.

Tread panel 20 includes a top surface 40, a bottom surface 42, a front edge 44, and a back edge 46, as illustrated in FIGS. 4 and 15. Riser panel 22 includes a front surface 50, a back surface 52, a top edge 54, and a bottom edge 56, as illustrated in FIGS. 4 and 15. Connection flange 24 includes a front surface 60, a back surface 62, a top edge 64, and a bottom edge 66, as illustrated in FIG. 4. In illustrative embodiments, top edge 54 of riser panel 22 is coupled to front edge 44 of tread panel 20, and back edge 46 of tread panel 20 is coupled to top edge 64 of connection flange 24. Each step member 12 is generally identical to other step members 12 in stair assembly 10.

Figures 6, 7:
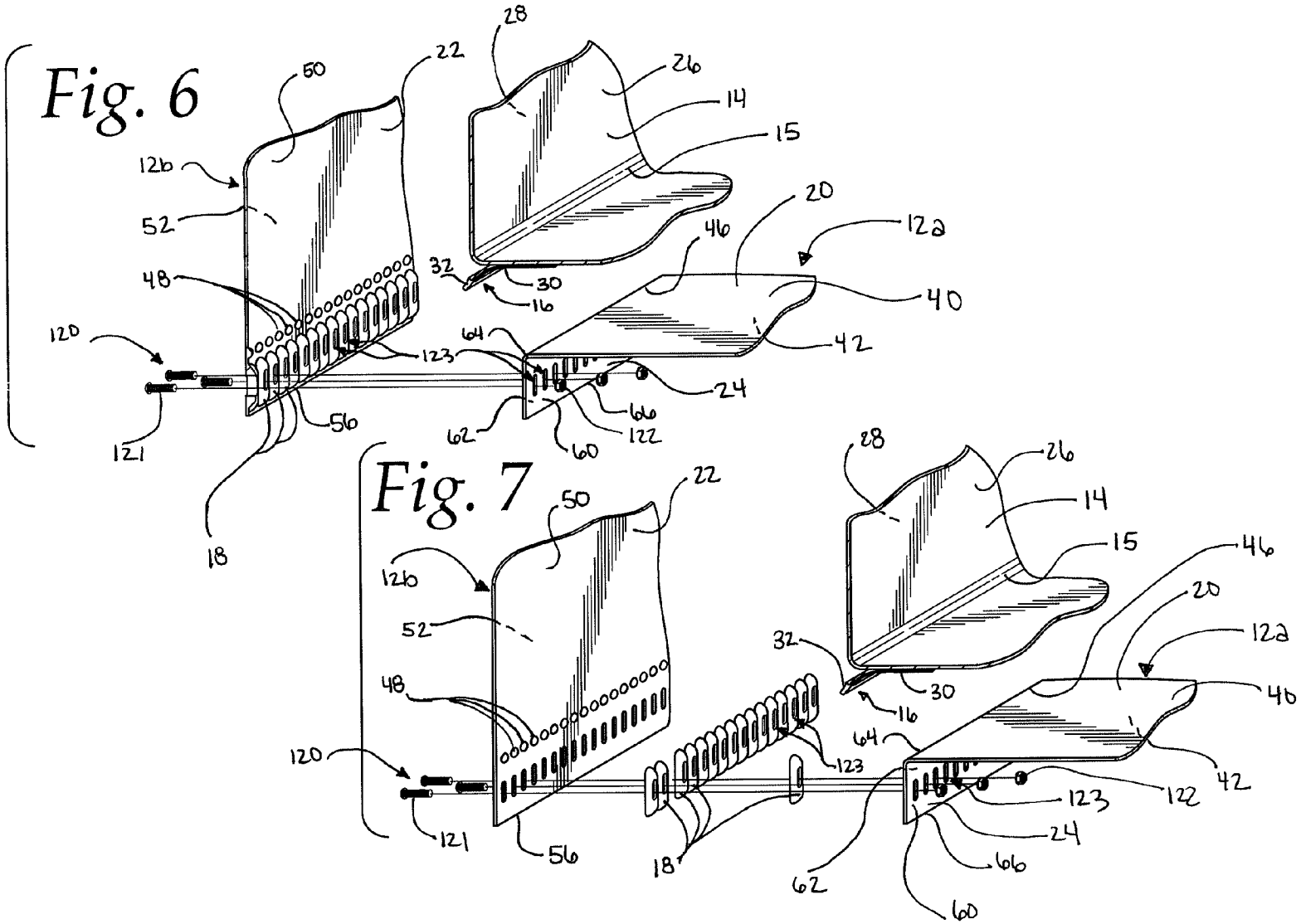
FIG. 6 is an exploded perspective view of an alternative embodiment of the stair assembly of the present disclosure, the stair assembly including spacers stamped into the step member to form a channel to receive the locking tab.
FIG. 7 is an exploded perspective view of an alternative embodiment of the stair assembly of the present disclosure, the stair assembly including separate spacers to form a channel to receive the locking tab.
Figure 11:
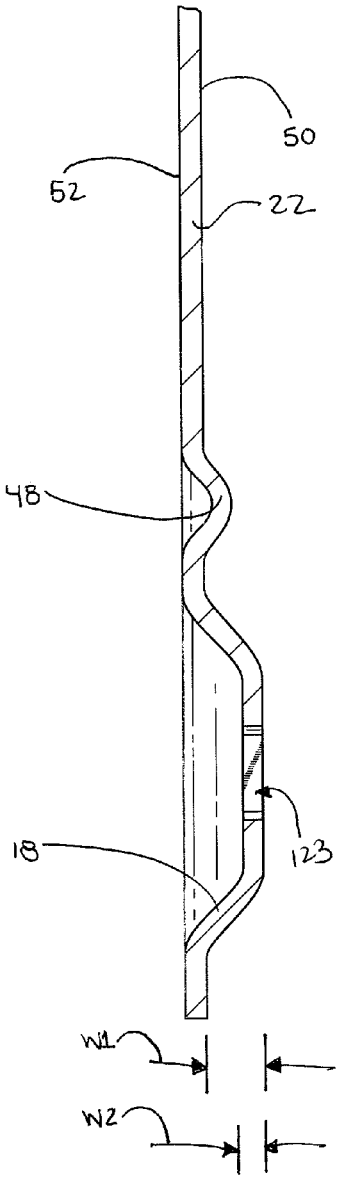
FIG. 11 is a cross-sectional side view of a portion of the step member of FIG. 6, showing the step member includes a detent and spacer formed from a stamping process.
Figure 12:
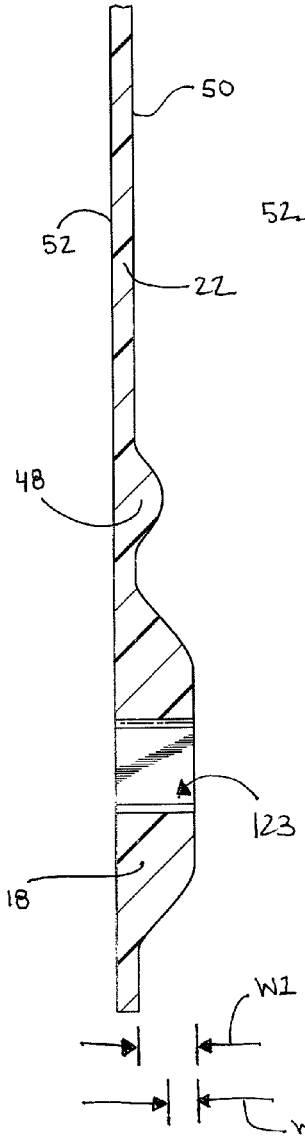
FIG. 12 is a cross-sectional view of a portion of the step member of FIG. 4, showing the step member includes a detent and spacer formed from a molding process.
Figure 13:
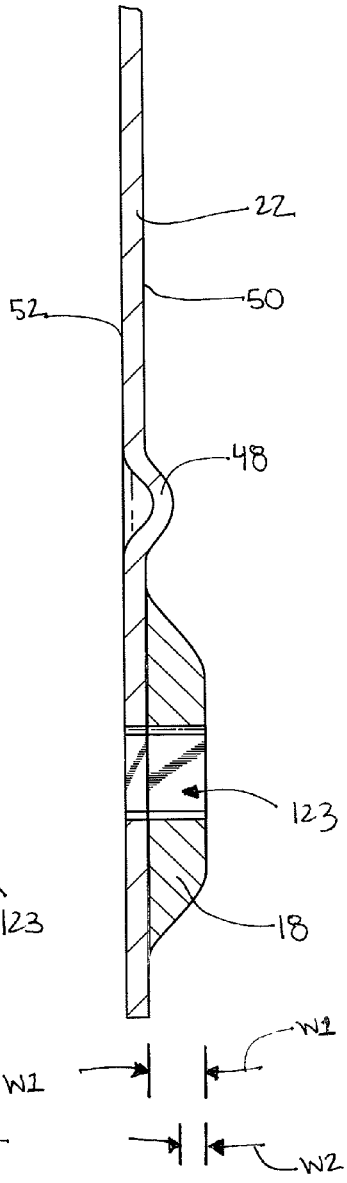
FIG. 13 is a cross-sectional view of a portion of the step member of FIG. 7, showing the step member includes a detent formed from a stamping process, a separate spacer being secured to the step member.

When two step members 12*a* and 12*b* are coupled together, stair assembly 10 is formed to include channel 11 between back edge 46*a* of tread panel 20*a* of a first step member 12*a* and riser panel 22*b* of a second step member 12*b*, as illustrated in FIGS. 4-10. In an illustrative embodiment and as illustrated in FIG. 7, channel 11 may be formed by including a plurality of spacers 18 between connection flange 24*a* of first step member 12*a* and riser panel 22*b* of second step member 12*b*. In another illustrative embodiment, channel 11 may also be formed by molding or stamping riser panel 22*b* to form a plurality of spacers 18 that bulges out from front surface 50*b* of riser panel 22*b* into channel 11 to abut against back surface 62*a* of connection flange 24*a*, as illustrated in FIGS. 4, 6, and 8-10. Similarly, channel 11 may also be formed by molding or stamping connection flange 24*a* to form a plurality of spacers 18 that bulges out from back surface 62*a* of connection flange 24*a* into channel 11 to abut against front surface 50*b* of riser panel 22*b*. Other known methods of forming channel 11 when connection flange 24 is coupled to riser panel 22 may be applicable or apparent to those skilled in the art in view of the foregoing description.

In a first illustrative embodiment, front surface 50 of riser panel 22 includes a detent 48 near bottom edge 56 that is configured to extend partially into channel 11, as illustrated in FIG. 9. When connection flange 24 is coupled to riser panel 22, detent 48 is located between bottom edge 56 of riser panel 22 and top edge 54 of connection flange 24*a*. Detent 48 may be located between spacer 18 and top edge 54 of connection flange 24*a*. In a second, alternative illustrative embodiment, back surface 62 of connection flange 24 may include detent 48 near top edge 64, detent 48 similarly configured to extend partially into channel 11.

Locking tab 16 includes an elongated web 30, a free-hanging tab extension 32 coupled to elongated web 30, and a lip 34 coupled to tab extension 32. As illustrated in FIGS. 3 and 8-10, elongated web 30 includes a bonded section 36 and a free section 38. Bonded section 36 is coupled to bottom surface 28 of pool liner 14 at predetermined positions along pool liner 14 to align tab extension 32 with channel 11 when liner 14 is placed over step members 12 to assemble pool stair assembly 10. Free section 38 is spaced away from bottom surface 28 of pool liner 14. Elongated web 30 may be coupled to bottom surface 28 by any known means of coupling or bonding, including but not limited to welding, adhesive or application of heat between elongated web 30 and bottom surface 28. In illustrative embodiments, free-hanging tab extension 32, elongated web 30, and lip 34 may be formed of one unitary piece such that locking tab 16 is one molded component.

Figure 3:
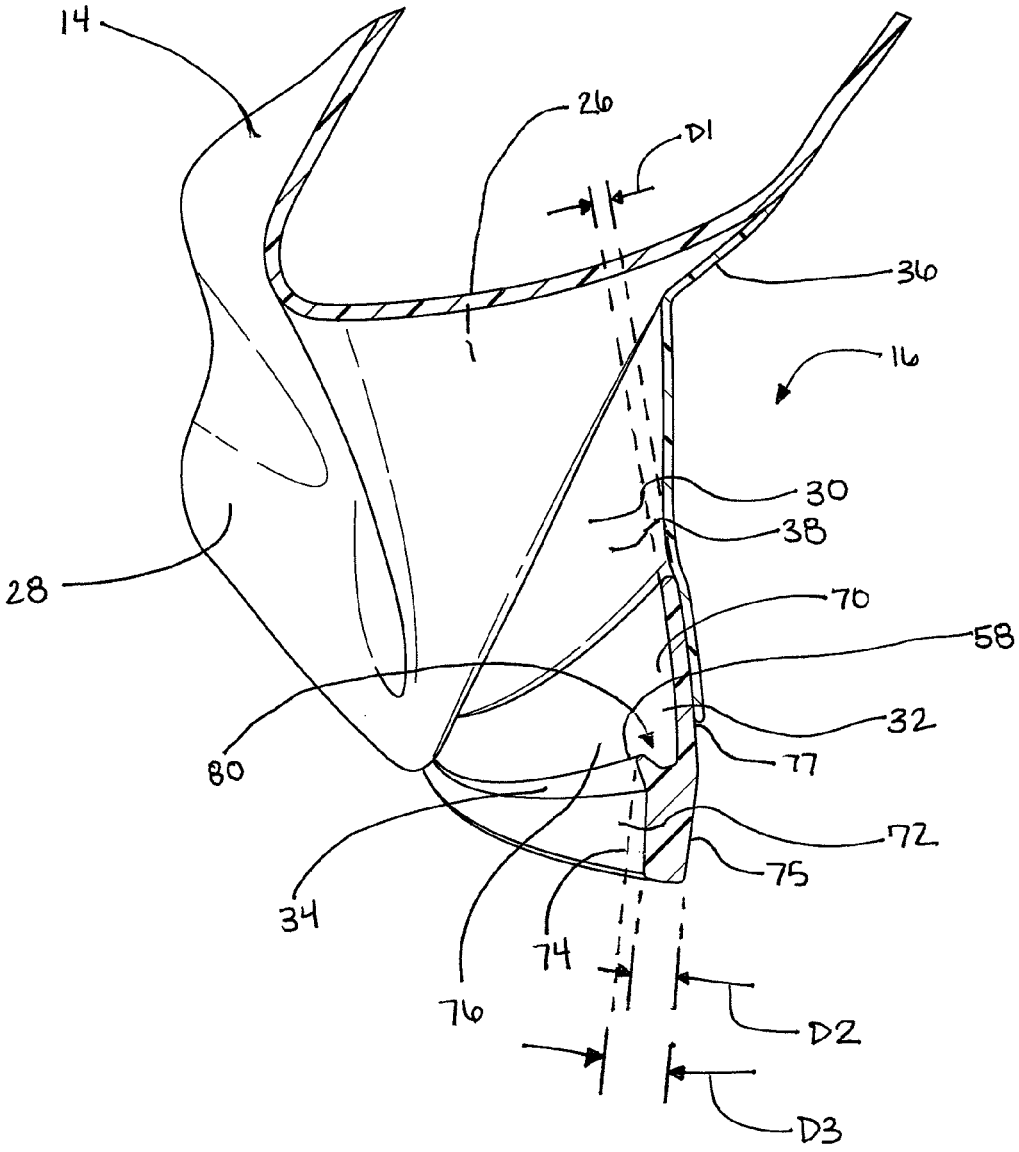
FIG. 3 is a cross-sectional view of a pool liner and a locking tab coupled to the bottom of the pool liner, the pool liner and locking tab configured to be coupled together with the step members of FIG. 2 to form the stair assembly of FIG. 1.

Free-hanging tab extension 32 is coupled to free section 38 of elongated web 30 such that free section 38 extends between bottom surface 28 and tab extension 32, as illustrated in FIG. 3. Tab extension 32 is configured to be inserted into channel 11 when connection flange 24*a* of first step member 12*a* is coupled to riser panel 22*b* of second step member 12*b*. Tab extension 32 includes a connection panel 70 and an insertion tang 72, as illustrated in FIG. 3. Connection panel 70 is coupled to free section 38 such that insertion tang 72 is spaced away from free section 38 when tab extension 32 is coupled to elongated web 30. Insertion tang 72 has a first side wall 74 and a second side wall 75, with the distance between first side wall 74 and second side wall 75 being D2, as illustrated in FIG. 3. Similarly, connection panel 70 has a first side wall 76 and a second side wall 77, the distance between first side wall 76 and second side wall 77 being D1. Second side wall 75 of insertion tang 72 and second side wall 77 of connection panel 70 may be coplanar and formed as a unitary surface.

As illustrated in FIGS. 3, 8-10, and 14, lip 34 of locking tab 16 is coupled to first side wall 74 of insertion tang 72 and extends outward and away from first side wall 74. A tip 58 of lip 34 and insertion tang 72 define a pocket 80 of locking tab 16. In the natural state of lip 34, the distance between tip 58 of lip 34 and second side wall 77 is configured to be D3, with D3 being a greater than distance D2, as illustrated in FIG. 3. Lip 34 is configured to be generally flexible with respect to insertion tang 72 and is configured to move into pocket 80 when compression force is applied to lip 34.

In use of stair assembly 10, channel 11 is configured to have a width W1, where width W1 is measured as the distance between front surface 50 of riser panel 22 and back surface 62 of connection flange 24, as illustrated in FIG. 9. As illustrated, detent 48 may be coupled to front surface 50 of riser panel 22 such that detent 48 extends into channel 11, creating a distance W2 between detent 48 and back surface 62 of connection flange 24, as illustrated in FIG. 9. In an alternative embodiment, detent 48 may be coupled to back surface 62 and extend into channel 11 such that distance W2 may exist between detent 48 and front surface 50 of riser panel 22. W2 is configured to be less than W1.

Width W2 is configured to be equal to or slightly larger than distance D2 so to allow insertion tang 72 of tab extension 32 to fit inside channel 11 in a snug manner such that walls 74 and 75 of insertion tang 72 frictionally engage with detent 48 and front surface 50 in illustrative embodiments. As locking tab 16 is inserted into channel 11, lip 34 is compressed into pocket 80 by engagement with detent 48, causing the distance between tip 58 of lip 34 and second side wall 77 to decrease to approximately the distance D2. Once lip 34 is compressed, insertion tang 72 can slide further into channel 11 and past detent 48. As illustrated in FIG. 10, after insertion tang 72 has slid past detent 48, the natural bias of lip 34 will bias lip 34 out of pocket 80, allowing the distance between tip 58 of lip 34 and second side wall 77 to return to the distance D3. As such, tip 58 of lip 34 will abut against a bottom side 49 of detent 48, blocking locking tab 16 from upward movement out of channel 11.

In alternative embodiments, connection flange 24 may be coupled to riser panel 22*b* of step member 12*b* instead of tread panel 20*a* of step member 12*a*. In such an embodiment, connection flange 24*b* may be coupled to bottom edge 56*b* of riser panel 22*b* to be perpendicular to riser panel 22*b* and extend in a direction towards back edge 46*b* of tread panel 20*b*. Connection flange 24*b* would be generally parallel to tread panel 20*a* of neighboring step member 12*a*, and would be coupled to tread panel 20*a* to form channel 11 between connection flange 24*b* and tread panel 20*a*. Thus, channel 11 may be formed in either vertical or horizontal planes of step members 12 to provide means for locking tab 16 to be inserted into channel 11 for securement of pool liner 14. In another alternative embodiment, connection flange 24 may be a separate component from riser panel 22 and tread panel 20 of step members 12, with connection flange 24 being coupled to either riser panel 22 or tread panel 20 during installation of step member 12 to form stair assembly 10. Other methods of forming a gap or channel 11 between step members 12 may be known to one skilled in the art in light of this disclosure. Lip 34 may be coupled to one side of locking tab 16 to configure lip 34 to engage with detent 48 if detent 48 is located on the front surface 50 of riser panel 22 or on the opposite side of locking tab 16 to configure lip 34 to engage with detent 48 if detent 48 is located on the back surface 62 of connection flange 24

Step members 12 may be coupled together in any known method of coupling. In illustrative embodiments and as illustrated in FIGS. 4-10, riser panel 22 and connection flange 24 may be coupled together by means of a fastener assembly 120. Fastener assembly 120 may be located between the bottom edge 56 of riser panel 22 and detent 48 and extend through channel 11. Fastener assembly 120 may include a bolt 121 that extend through apertures 123 formed in riser panel 22 and connection flange 24 and is secured by a nut 122', as illustrated in FIGS. 4-10. Fastener assembly 120 may also include other mechanical means of connecting step members 12. Further, spacer 18 may be secured between riser panel 22 and connection flange 24 by fastener assembly 120. Other embodiments of fastener assembly 120 are also envisioned.

Figure 14:
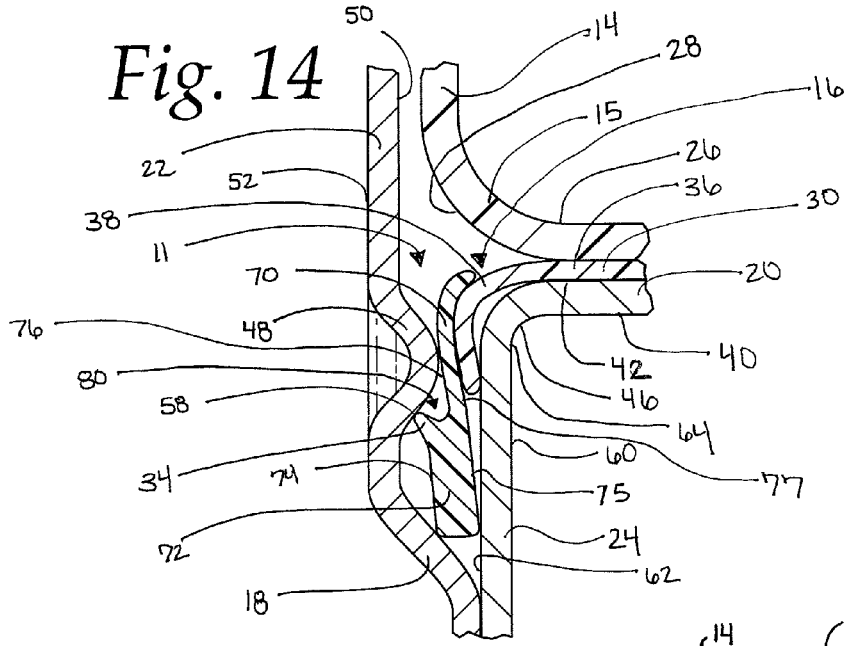
FIG. 14 is a detailed view of the interaction between the locking tab and the detent of FIG. 10.

The configuration of locking tab 16 and its attachment to bottom surface 28 of pool liner 14 at predetermined locations enables a substantial portion of locking tab 16 to be inserted into channel 11 when pool liner 14 is coupled to step members 12. When pool liner 14 is coupled to step members 12, a bend 15 is naturally created in pool liner 14 as pool liner 14 covers tread panel 20 and riser panel 22 that are perpendicular to each other. In illustrative embodiments, bend 15 is located generally above channel 11. As illustrated in FIGS. 10 and 14, the configuration of locking tab 16 to enable a substantial portion of locking tab 16 to be inserted into channel 11 enables bend 15 of pool liner 14 to have a relatively smooth concave surface free of any interruptions as it extends over tread panel 20, across channel 11, and over riser panel 22.

In accordance with the present disclosure, a pool stair assembly 10 is provided comprising a first step member 12*a* having a first tread panel 20*a*, a first riser panel 22*a* that is generally perpendicular to the first tread panel 20*a*, and a connection flange 24*a* coupled to the first tread panel 20*a*; a second step member 12*b* having a second tread panel 20*b* and a second riser panel 22*b* that is generally perpendicular to the second tread panel 20*b*; a pool liner 14 having a top surface 26 and a bottom surface 28; a locking tab 16 coupled to the bottom surface 28 of the pool liner 14; wherein the connection flange 24*a* of the first step member 12*a* is adapted to be coupled to the second riser panel 22*b* of a second step member 12*b* to form a channel 11 therebetween, the channel 11 configured to accept the locking tab 16 coupled to the pool liner 14 to retain the pool liner 14 against the stair assembly 10 to prevent unwanted movement of the pool liner 14 with respect to the first and second step members 12*a*, 12*b*; and wherein the locking tab 16 is configured to be coupled to the bottom surface 28 of the pool liner 14 at predetermined locations that correspond with the channel 11, the locking tab 16 configured to allow the pool liner 14 above the channel 11 to form a smooth concave bend 15 as it extends from the first tread panel 20*a* to the second riser panel 22*b* across the channel 11.

The pool stair assembly 10 includes a detent 48 that extends into the channel 11 from either the second riser panel 22*b* or the connection flange 24*a* to retain the locking tab 16 in the channel 11, and the detent 48 may be stamped or molded into the second riser panel 22*b* or the connection flange 24*a*. The detent 48 extends approximately one-half the distance of the width W1 of channel 11. The detent 48 may be located closer to the first tread panel 20*a* of the first step member 12*a* than a bottom edge 56*b* of the second riser panel 22*b* of the second step member 12*b* when the first step member 12*a* and second step member 12*b* are coupled together. A series of spaced apart detents 48 may extend into channel 11

The channel 11 of pool stair assembly 10 may be formed between the second riser panel 22*b* and the connection flange 24*a* by a spacer 18 located between the second riser panel 22*b* and connection flange 24*a* when the second riser panel 22*b* and the connection flange 24*a* are coupled together. The spacer 18 may be stamped from or molded with the second riser panel 22*b* or the connection flange 24*a*. The spacer 18 may be located between a bottom edge 56*b* of the second riser panel 22*b* and the detent 48 extending into the channel 11. The second riser panel 22*b* and connection flange 24*a* may be coupled together by a fastener assembly 120 located between the bottom edge 56*b* of the second riser panel 22*b* and the detent 48.

The locking tab 16 of pool stair assembly 10 may include an elongated web 30 and a free-hanging tab extension 32. The elongated web 30 may be coupled to the bottom surface 28 of the pool liner 14 and the tab extension 32 may be coupled to the elongated web 30 to be free-hanging. The tab extension 32 may include a connection panel 70 and an insertion tang 72, and the elongated web 30 may be coupled to the connection panel 70 such that the insertion tang 72 is spaced away from the elongated web 30. A lip 34 may be coupled to the insertion tang 72 to extend away from the insertion tang 72. The lip 34 may engage with the detent 48 extending into the channel 11 to retain the locking tab 16 within the channel 11.

The locking tab 16 may be coupled to the pool liner 14 after the pool liner 14 has been fully assembled. The locking tab 16 may be welded to the pool liner 14 or may be connected to the pool liner 14 by any other means known in the art.

In alternative embodiments, locking tab 16 and pool liner 14 may be configured to be secured to different components of a swimming pool 100 that are similar in shape to step member 12, such as a bench or sun ledge. Locking tab 16 may be configured to be received by any components that include a means for forming a channel 11 when coupled together.

Although directional language may be used throughout the specification, such directions are intended to convey the scope of the present disclosure rather than limit the scope of the present disclosure. It should be understood that a direction, such as up, down, back, front, etc., may change depending on the orientation of one or more components of the travel golf bag disclosed herein.

Various features of the disclosure have been shown and described in connection with the illustrated embodiment, however, it is understood that these arrangements merely illustrate, and that the disclosure is to be given its fullest interpretation.

I claim:

1. A pool stair system comprising:

a first step member having a first tread panel, a first riser panel that is generally perpendicular to the first tread panel, and a connection flange coupled to the first tread panel;

a second step member having a second tread panel and a second riser panel that is generally perpendicular to the second tread panel, the second riser panel having a plurality of spacers disposed in a linear fashion along a length thereof;

a pool liner having a top surface and a bottom surface;

a locking tab coupled to the bottom surface of the pool liner;

wherein the connection flange of the first step member is adapted to be coupled to the second riser panel of the second step member with the plurality of spacers extending therebetween to form a channel between the connection flange and the second riser panel, the channel configured to accept the locking tab coupled to the pool liner to retain the pool liner against the stair assembly to prevent unwanted movement of the pool liner with respect to the first and second step members.

2. The pool stair system of claim 1, wherein the connection flange is generally perpendicular to the first tread panel.

3. The pool stair system of claim 1, wherein a detent extends into the channel from either the second riser panel or the connection flange to retain the locking tab in the channel.

4. The pool stair system of claim 3, wherein the detent is stamped into the second riser panel.

5. The pool stair system of claim 3, wherein the detent is located closer to the first tread panel of the first step member than a bottom edge of the second riser panel of the second step member when the first step member and second step member are coupled together.

6. The pool stair system of claim 4, wherein the detent extends approximately one-half the distance of the width of the channel.

7. The pool stair system of claim 1, wherein a series of spaced apart detents extend into the channel.

8. The pool stair system of claim 1, wherein the channel is formed between the second riser panel and the connection flange by the plurality of spacers located between the second riser panel and connection flange when the second riser panel and the connection flange are coupled together.

9. The pool stair system of claim 8, wherein the plurality of spacers is stamped from or molded with the second riser panel.

10. The pool stair system of claim 8, wherein the plurality of spacers is molded with the connection flange.

11. The pool stair system of claim 8, wherein the plurality of spacers is located between a bottom edge of the second riser panel and a detent extending into the channel.

12. The pool stair system of claim 11, wherein the second riser panel and connection flange are coupled together by a fastener assembly located between the bottom edge of the second riser panel and the detent.

13. The pool stair system of claim 1, wherein the locking tab includes an elongated web and a tab extension.

14. The pool stair system of claim 13, wherein the elongated web is coupled to the bottom surface of the pool liner and the tab extension is coupled to the elongated web to be free-hanging.

15. The pool stair system of claim 14, wherein the tab extension includes a connection panel and an insertion tang.

16. The pool stair system of claim 15, wherein the elongated web is coupled to the connection panel and the insertion tang is spaced away from the elongated web.

17. The pool stair system of claim 15, wherein the locking tab includes a lip that engages with a detent extending into the channel to retain the locking tab within the channel.

18. The pool stair system of claim 16, wherein a lip is coupled to the insertion tang and extends away from the insertion tang.

19. The pool stair system of claim 18, wherein the lip engages with a detent extending into the channel to retain the locking tab within the channel.

20. The pool stair system of claim 1, wherein the locking tab includes a lip that engages with a detent extending into the channel to retain the locking tab within the channel.

21. The pool stair system of claim 1, wherein the locking tab is coupled to the pool liner after the pool liner has been fully assembled.

22. The pool stair system of 21, wherein the locking tab is welded to the pool liner.

23. The pool stair system of claim 1, wherein the locking tab is configured to allow the pool liner above the channel to form a smooth concave bend as it extends from the first tread panel to the second riser panel across the channel.

24. A pool stair assembly comprising:

a series of step members, each step member having a tread panel and a riser panel generally perpendicular to the tread panel;

a plurality of spacers disposed in a linear fashion to form a channel between a first step members and second step member when the first and second step members are coupled together to form an assembled stairway, the channel having a first channel width;

a pool liner having a top surface and a bottom surface;

a locking tab coupled to the bottom surface of the pool liner, the locking tab including an tab extension and a retaining lip, the tab extension being configured to be inserted inside the channel and the retaining lip coupled to the tab extension, the retaining lip being flexible and having a flexed position and a non-flexed position, the retaining lip being naturally biased to the non-flexed position;

a detent extending into the channel to narrow the channel at the location of the detent to form a second channel width;

wherein the width of the locking tab at the retaining lip when the retaining lip is in the non-flexed position is greater than the second channel width, the retaining lip abutting against the detent to move the retaining lip to the flexed position when the locking tab is inserted into the channel, and the retaining lip moving back to the non-flexed position after the retaining lip passes the detent as the locking tab continues to be inserted into the channel so that the retaining lip abuts against the detent to lock pool liner from unwanted movement; and wherein the locking tab is configured to be coupled to the bottom surface of the pool liner at predetermined locations that correspond with the channel.

25. The pool stair assembly of claim 24, wherein the spacer is stamped from or molded with the step members.

26. The pool stair assembly of claim 24, wherein the step members are coupled together by a fastener assembly that extends through the spacer.

27. The pool stair assembly of claim 24, wherein the locking tab includes an elongated web and an insertion tang, the elongated web connecting the insertion tang to the bottom surface of the pool liner such that the insertion tang is free-hanging.

28. The pool stair assembly of claim 24, wherein the second channel width is approximately one-half the distance of the first channel width.

29. The pool stair assembly of claim 28, wherein the detent is stamped or molded with the step members.

30. The pool stair assembly of claim 29, wherein the detent is located below a mouth of the channel.

31. The pool stair assembly of claim 24, wherein the pool liner is one continuous piece extending across the stair members.

32. The pool stair assembly of claim 24, wherein the locking tab is configured to allow the pool liner above the channel to form a smooth concave bend as it extends from the first step member to the second step member across the channel.

33. A pool installation kit, comprising:

one or more side walls;

a pool base coupled to and extending between the side walls;

a pool stair assembly coupled to the side walls;

wherein the stair assembly including a series of step members, each step member having a tread panel and a riser panel that is generally perpendicular to the tread panel, the riser panel having a plurality of spacers disposed in a linear fashion along an end of the riser panel, the stair assembly also including a connection flange to couple the step members together with the spacers disposed between the step members to form a channel therebetween, the stair assembly also including a pool liner and a locking tab coupled to the pool liner; and wherein the channel is configured to accept the locking tab coupled to the pool liner to retain the pool liner against the stair assembly to prevent unwanted movement of the pool liner with respect to the step members, and wherein the locking tab is configured to be coupled to the pool liner at predetermined locations that correspond with the channel.

* * * * *